United States Patent [19]

Armbruster

[11] Patent Number: 4,856,968

[45] Date of Patent: Aug. 15, 1989

[54] AIR CIRCULATION DEVICE

[76] Inventor: Joseph M. Armbruster, 2700 N.E. 47th St., Lighthouse Point, Fla. 33064

[21] Appl. No.: 151,606

[22] Filed: Feb. 2, 1988

[51] Int. Cl.[4] ..... F04B 39/14

[52] U.S. Cl. ..... 417/360; 417/313; 417/423.15; 417/126; 248/181

[58] Field of Search ..... 417/313, 360, 423 R, 417/423 K, 423 L, 423 T; 415/126, 148, 150, 121 R; 248/181, 481; D15/9

[56] References Cited

U.S. PATENT DOCUMENTS

| | | | |
|---|---|---|---|
| D. 32,828 | 6/1900 | Mayer | D 15/9 |
| 1,288,461 | 12/1918 | Akeley | 248/181 |
| 2,316,224 | 4/1943 | D'Elia | 415/148 |
| 2,439,182 | 4/1948 | Nuffer et al. | 415/148 X |
| 2,659,294 | 11/1953 | Hersperger | 415/126 X |
| 2,703,199 | 3/1955 | Drake | 417/369 X |
| 3,960,527 | 6/1976 | Goettl | 417/423 T X |
| 4,424,006 | 1/1984 | Armbruster | 417/313 X |
| 4,518,325 | 5/1985 | Kingston | 417/423 T X |
| 4,566,663 | 1/1986 | Barchus | 248/181 X |

*Primary Examiner*—Leonard E. Smith
*Assistant Examiner*—Eugene L. Szczecina, Jr.
*Attorney, Agent, or Firm*—Fleit, Jacobson, Cohn, Price, Holman & Stern

[57] ABSTRACT

An air circulation device and more particularly an air circulation device having a dome shaped housing enclosing all moving components of an air blower which incorporates a squirrel cage impeller in a casing provided with an air inlet and discharge. A supporting structure enables adjustment of the dome shaped housing for discharging air in a desired direction. The air blower discharge communicates with and is connected with a peripherally extending outlet in the housing in the form of a plurality of slots with a transition member sealingly connected to the blower discharge and air outlet. The housing also includes an air inlet with a removable filter so that inlet air completely surrounds the blower in the housing. The upper portion of the housing may be provided with an illumination device and several embodiments of the housing and support structure are disclosed.

10 Claims, 3 Drawing Sheets

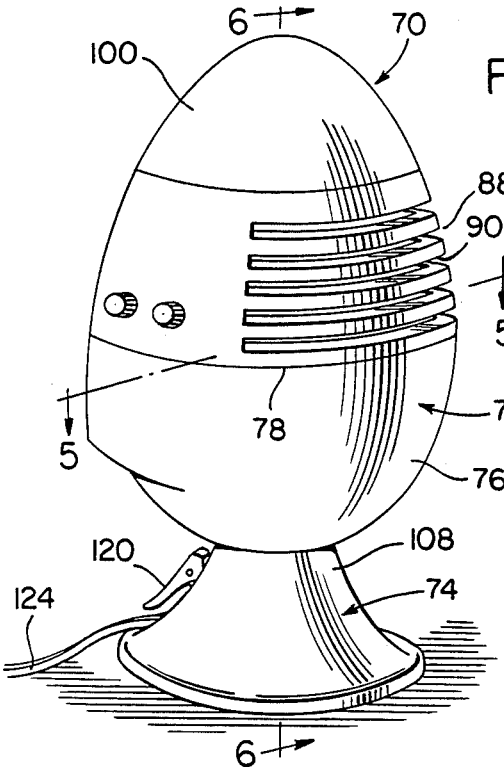
FIG. 4
FIG. 5
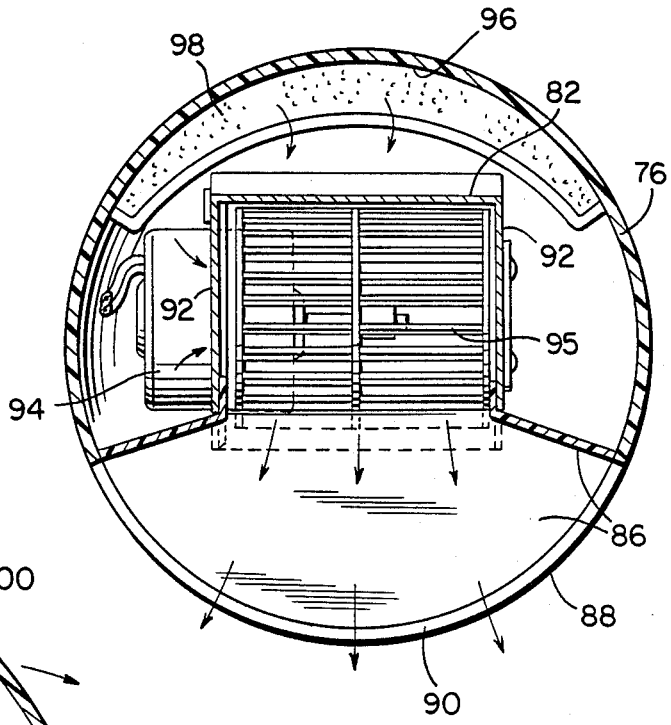
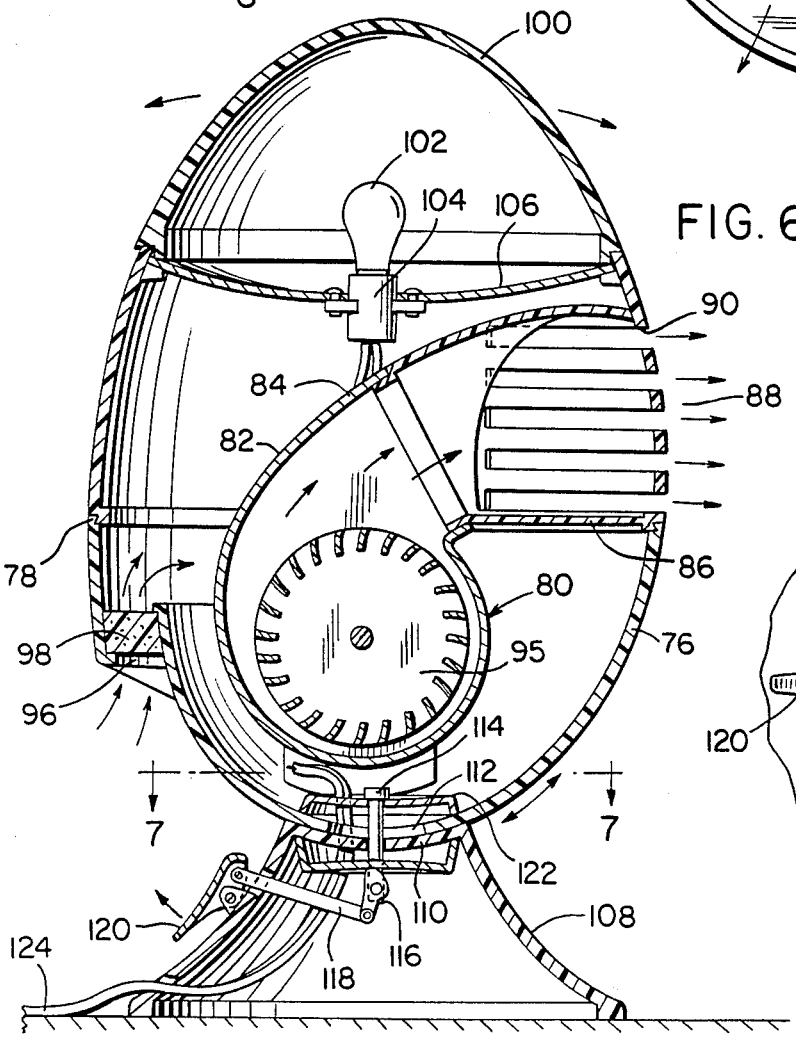
FIG. 6
FIG. 7
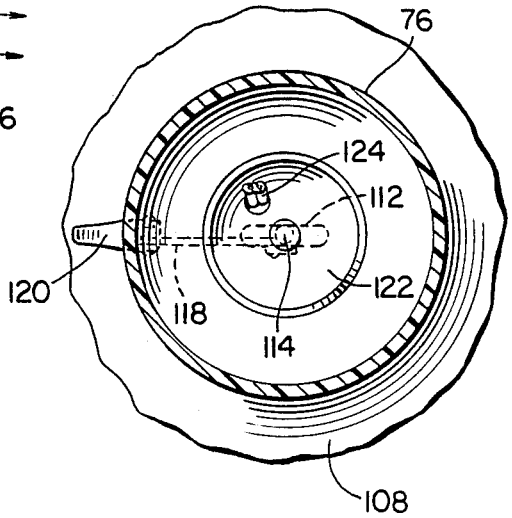

FIG. 8
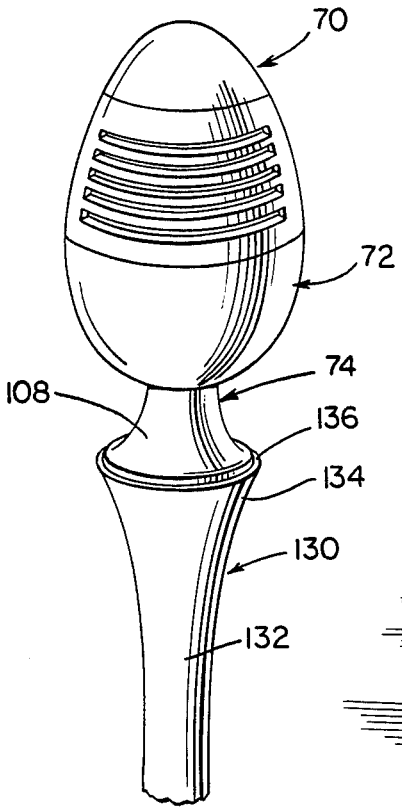
FIG. 9
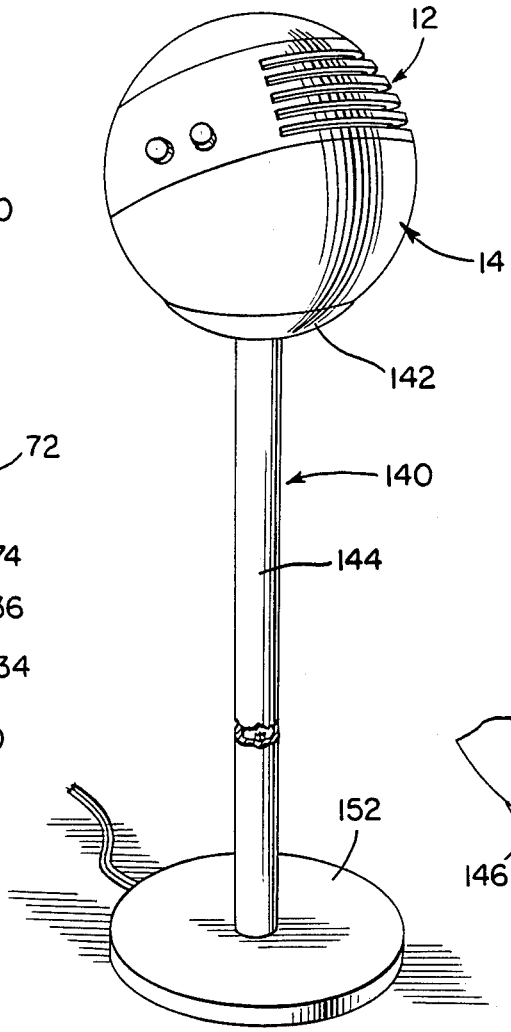
FIG. 10
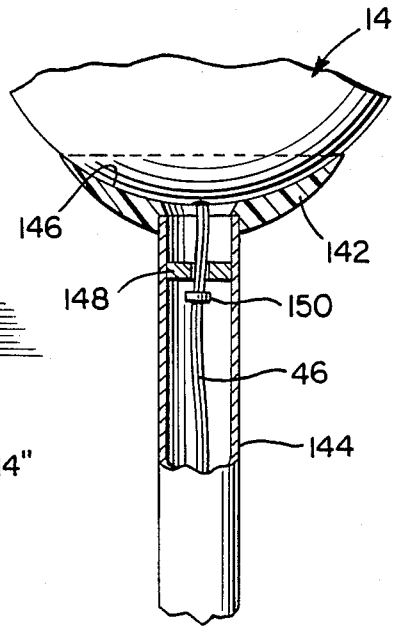
FIG. 11
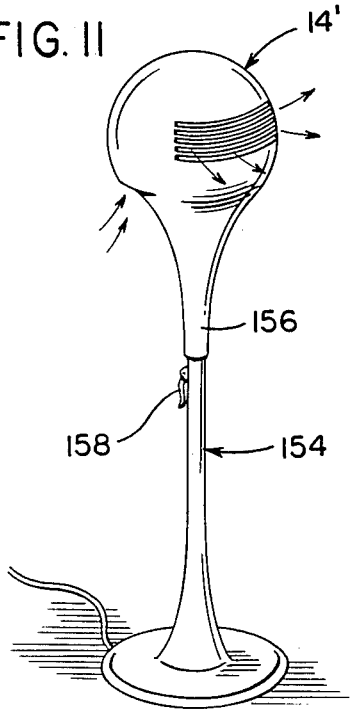
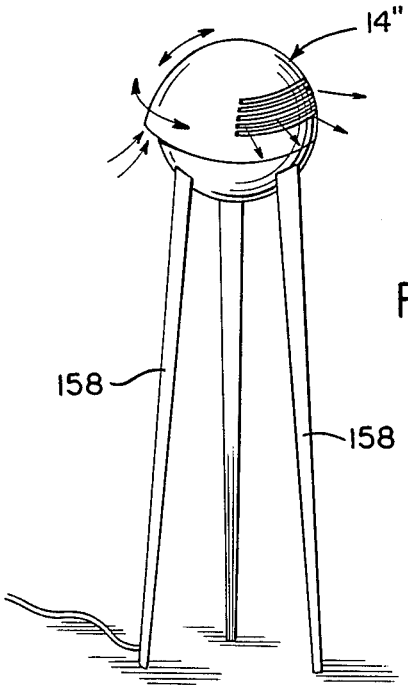
FIG. 12

AIR CIRCULATION DEVICE

BACKGROUND OF THE INVENTION

FIELD OF THE INVENTION

The present invention generally relates to an air circulation device and more particularly an air circulation device having a dome shaped housing enclosing all moving components of an air blower which incorporates a squirrel cage impeller in a casing provided with an air inlet and discharge. A supporting structure enables adjustment of the dome shaped housing for discharging air in a desired direction. The air blower discharge communicates with and is connected with a peripherally extending outlet in the housing in the form of a plurality of slots with a transition member sealingly connected to the blower discharge and air outlet. The housing also includes an air inlet with a removable filter so that inlet air completely surrounds the blower in the housing. The upper portion of the housing may be provided with an illumination device and several embodiments of the housing and support structure are disclosed.

INFORMATION DISCLOSURE STATEMENT

Prior patents disclose various types of fans for circulating air including bladed fans in which the blades include a wire frame enclosing the blades for safety purposes with the blades causing axial flow in relation to the rotational axis of the blades. Other types of air circulation devices are known in which impeller type air blowers are provided for circulation of air in a desired direction. However, the prior patents do not disclose a housing structure and air blower associated therewith in a manner equivalent to the present invention.

SUMMARY OF THE INVENTION

An object of the present invention is to provide an air circulation device in which the housing for the device is in the configuration of a dome provided with an arcuate, downwardly facing air inlet and a peripherally extending air outlet in the form of a plurality of slots forming directional control louvers.

Another object of the invention is to provide an air circulation device in which the apparatus for circulating air is a dual or single impeller air blower having a discharge opening connected to the air outlet in the housing by a transition member sealed to the blower outlet and the housing peripherally of the outlet slots in the housing.

A further object of the invention is to provide an air circulation device in accordance with the preceding objects incorporating a unique supporting arrangement for the dome shaped housing to enable easy adjustment thereof in both a horizontal attitude and a vertical attitude for directing the discharge of air to a desired location.

Still another object of the invention is to provide an air circulation device in the form of an oval shaped dome having a supporting base and a control mechanism to secure the housing in adjusted position about a transverse and a longitudinal axis.

A still further object of the invention is to provide an air circulation device in accordance with the preceding objects in which the upper portion of the dome housing is provided with an illumination arrangement to provide a room light or the like.

Yet another important object of the invention is to provide an air circulation device which is safe in operation since the housing completely encloses all of the moving parts, capable of moving large volumes of air, provided with a low noise level and being attractive in design in order to be aesthetically pleasing.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a perspective view of an oval shaped or egg shaped dome-type air circulation device in the form of a table model air circulation device.

FIG. 5 is a transverse, plan sectional view taken substantially upon a plane passing along section line 5—5 on FIG. 4 illustrating the association of the air inlet, air blower and air outlet.

FIG. 6 is a vertical, sectional view taken substantially upon a plane passing along section line 6—6 on FIG. 4 illustrating further structural details of this embodiment of the invention.

FIG. 7 is a fragmental plan sectional view taken substantially upon a plane passing along section line 7—7 on FIG. 6 illustrating the locking structure for securing the dome shaped housing in adjusted position.

FIG. 8 is a fragmental perspective view illustrating another supporting arrangement for the air circulation device of the present invention.

FIG. 9 is a perspective view of a pedestal-type of support for the dome shaped housing of the air circulation device.

FIG. 10 is a fragmental, sectional view of the construction of FIG. 9.

FIG. 11 is a perspective view of another embodiment of the invention.

FIG. 12 is a perspective view of still another embodiment of the invention.

DESCRIPTION OF THE PREFERRED EMBODIMENTS

Figure 1:
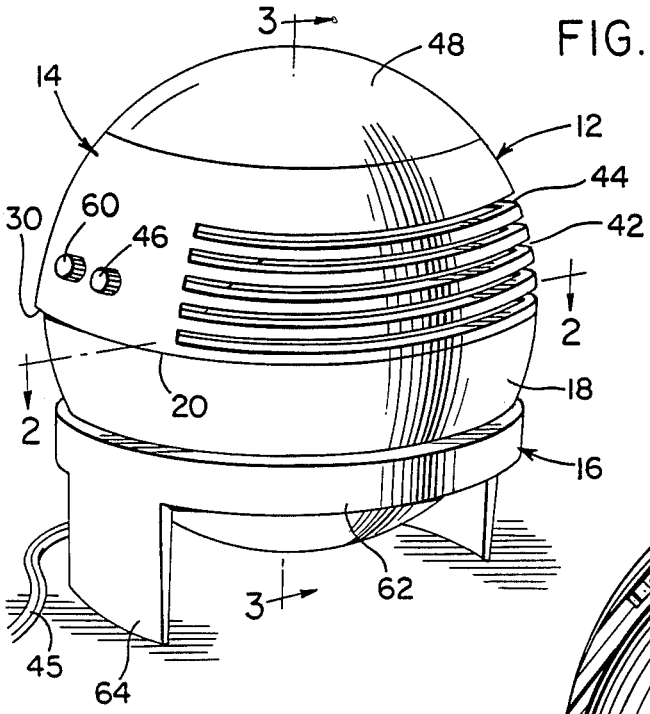
FIG. 1 is a perspective view of one embodiment of the air circulation device of the present invention.
Figure 2:
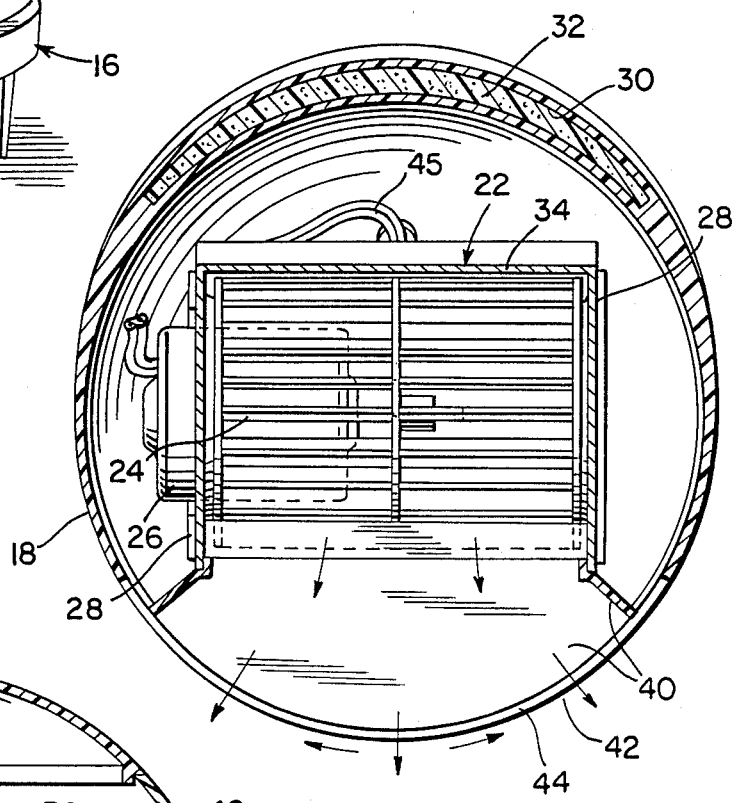
FIG. 2 is a transverse, plan sectional view taken substantially upon a plane passing along section line 2—2 on FIG. 1 illustrating the structural details of the housing and the association of the air blower therein.
Figure 3:
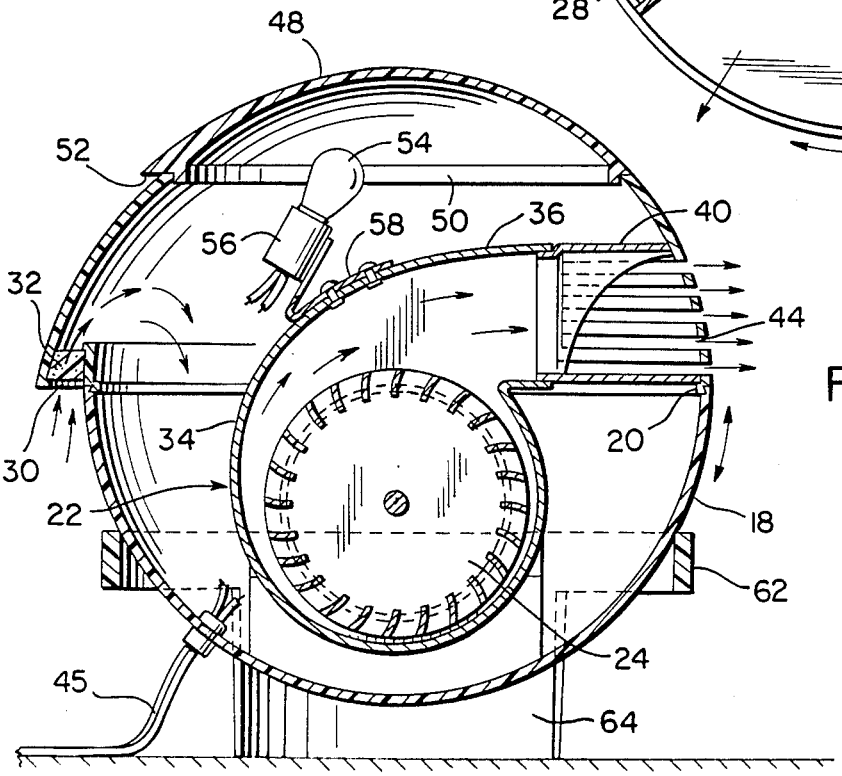
FIG. 3 is a vertical sectional view taken substantially upon a plane passing along section line 3—3 on FIG. 1 illustrating further structural details of the housing, blower and illumination device.

Referring now specifically to FIGS. 1-3, the air circulation device illustrated therein is generally designated by the numeral 12 and includes a substantially spherical housing 14 supported by a ring-type supporting base generally designated by the numeral 16. The housing 14 includes a shell 18 which may be constructed of metal, plastic or the like and the housing may be separated along an equator parting line 20 with the two halves of the housing being joined together by fasteners, a snap fit or by any other suitable means to provide a substantially symmetrical and spherical housing. The housing encloses a blower generally designated by reference numeral 22 which includes an impeller 24 having a motor 26 at one end thereof with an inlet 28 at each end thereof. The housing includes an inlet 30 which faces downwardly and is formed by a portion of the peripheral wall or shell 18 being spaced radially outwardly from an adjacent portion of the shell 18 as illustrated in FIG. 3 so that an arcuately extending inlet is formed as illustrated in FIG. 2 with the inlet 30 being provided with a filter 32 to filter the incoming air.

The blower 22 includes a housing or casing 34 having a tangential outlet 36 connected to a tubular transition member 40 that has one end thereof sealingly engaged with the outlet 36 and the other end sealingly contacting the interior surface of the shell 18 peripherally of a discharge area 42 formed by a plurality of parallel slots 44 thereby providing, in effect, a louvered discharge area.42 which extends around a substantial peripheral portion of the shell 18 as illustrated in FIGS. 1 and 2. The motor 26 is provided, with electrical energy through a suitable electric cord 45 extending through the shell 18 adjacent the bottom thereof and connected with the motor through a control switch 46 which may vary the speed of the motor and thus the output of the blower. The blower 22 is preferably provided with a plastic impeller 24 of the squirrel cage type to produce a relatively large air volume with minimum noise level. Also, the housing 14 completely encloses the blower 22 and all moving components thereby providing a completely safe air circulation device.

The upper portion of the spherical shell 18 is provided with a translucent or transparent area 48 forming a continuation of the spherical shell 18 which is connected to the upper end portion of the shell 18 by a snap fit as at 50 with a portion of the translucent or transparent partially spherical member 48 projecting laterally outwardly as at 52 where it joins with the shell 18 to enable the translucent member 48 to be lifted off the shell 18 in order to replace a light bulb 54 mounted in a socket 56 supported by a bracket 58 attached to the impeller housing 34 with the light 54 also being supplied electrical energy through a light switch 60 that is located adjacent the blower switch 46.

The ring-type base 16 includes a peripheral ring member 62 having a generally cylindrical configuration and provided with a pair of diametrically opposed depending supporting legs 64 which are arcuate and partially cylindrical as illustrated in FIG. 1 with the legs 64 being in alignment with and forming a continuation of diametrically opposed areas of the cylindrical supporting ring 62. As illustrated in FIG. 3, the lower portion of the spherical shell 18 rests in the ring 62 so the entire housing 14 can be adjusted so the discharge area 42 can be angled upwardly or downwardly from the horizontal as illustrated by the arrow in FIG. 3. Also, the housing 14 can be pivoted about a generally vertical axis within the ring 62 or the entire ring and housing 14 may be moved on a supporting surface in order to directionally control the orientation of the discharge area 42 so the air discharged by the blower 22 can be directed in a desired direction.

This device will deliver a high volume of air as compared to a fan having propeller-type blades. The dual inlet squirrel cage blower is totally encapsulated by the dome shaped housing 14. The discharge area 42 is aligned with and joined with the tangential discharge 36 of the blower 22 by the transition 40 which is peripherally connected to the tangential discharge 36 at one end and peripherally sealed around the discharge area 42 interiorly of the shell 18 by any suitable gasket or the like in order to direct air discharged from the squirrel cage blower directly to the discharge slots 40 which together with the area of the shell 18 above and below the slots form directional louvers.

The air inlet 30 is oppositely arranged on the housing 14 as compared to the discharge area 42 and includes an overhang or radial projection that faces the floor so that air taken into the inlet completely surrounds the blower inside the dome since the discharge transition is affixed to the blower and sealed to the dome. All intake air inside the dome can be inducted into the air intakes on either end of the blower housing. For some models, the blower can be a single inlet type to reduce the size but the function and principle of operation would remain the same. A snap-in filter can be inserted in the air intake opening and the filter can be either a foam plastic material for removing particulates or it may be activated carbon or a combination of the two if odor removal is also desired.

Referring now specifically to FIGS. 4–7, the embodiment of the air circulation device disclosed is generally designated by reference numeral 70 and includes a generally oval shaped or egg shaped dome housing 72 supported on a base 74. As in the embodiment illustrated in FIGS. 1–3, the housing 72 is in the form of a shell 76 having a horizontal parting line 78 with the two halves of the shell being secured together in any suitable manner. An air blower generally designated by the numeral 80 is supported within the shell 76 and includes a housing or casing 82 and a tangential outlet 84 connected to a transition member 86 which extends peripherally of and is connected to the end of the tangential outlet 84 at one end and is connected to a discharge area 88 at its other end with the discharge area being defined by a plurality of horizontally disposed arcuate slots 90 with the area above and below the slots defining a louvered discharge for air from the blower 80. The bower housing 82 includes air inlets 92 at each end thereof and a motor 94 driving the impeller 95. The lower portion of the shell is provided with an air inlet opening 96 having a filter 98 provided therein which may be a foam plastic filter or a carbon filter as illustrated in FIG. 5. Also, the upper portion of the shell may be provided with a translucent member 100 which can be transparent if desired with a light bulb 102 and light bulb socket 104 supported at the juncture of the translucent or transparent portion 100 and the upper portion of the shell 86 by a plate or spider 106. The translucent or transparent member 100 is snap fitted or pressure fitted into the upper end of the shell 76 and it can be easily removed by grasping the exterior surface or providing a projecting lip by which the member 100 can be lifted upwardly. The configuration of the shell 76 is such as to generally simulate a large egg with the major axis thereof extending vertically.

With this construction, the base 74 engages and supports a rounded lower end of the shell 76 and includes a peripheral wall 108 having a concave upwardly facing top wall 110 engaging and supporting the bottom surface of the end of the shell 76. The end of the shell 76 is provided with a slot 112 receiving a fastener member 114 which has a lower end secured to a cam structure 116 actuated by a rod 118 and a pivotal lever 120 disposed exteriorly of the base 108. The upper end of the fastener 114 is engaged with a plate 122 engageable with the inner surface of the shell so that when the lever 120 is oriented in the position for securing the shell in adjusted position, the plate 122 will be pulled downwardly to frictionally grip the shell against the upper surface of the top wall 110 of the base 74. This structure enables adjustment of the housing 72 about a transverse axis as indicated by the arrows in FIG. 6 in order to direct the discharge area 88 upwardly or downwardly in relation to horizontal within the limits of the arcuate extent of the slot 110 with the locking lever and associated link 118 and cam 116 together with the fastener 114 and plate 122 coacting to lock the housing 72 in adjusted position with the housing also being capable of being adjusted about a vertical axis in order to direct the discharge area 88 to a desired location. The motor 94 is supplied electrical energy through a cord 124 extending through the base 74 and upwardly into the shell 76 through a control switch 126 which can control the operation of the blower including the speed of the motor and impeller 96. Also, a light switch 128 is provided for controlling the light 102 which is supplied electrical energy in the same manner.

The egg shaped dome may or may not incorporate a light in the top area thereof and the base and the slot in the shell of the dome permits left or right horizontal movement as well as a 30° tilt-up or tilt-down from horizontal and the locking lever simply tightens the plate on the inside of the dome of the surface on the base to secure the dome in place on the base.

FIG. 8 illustrates a pedestal-type support 130 for the air circulation device 70 such as that illustrated in FIGS. 4–7 in which the housing 72 and base 74 are supported on top of a generally cylindrical and vertical support member 132 having an outward flared upper end 134 provided with a generally planar upper surface 136 on which the base 74 is supported by the lower end of the downwardly and outwardly flared wall 108 resting thereon with the base 74 being secured to the pedestal 130 in any suitable manner or merely resting thereon by gravity.

FIG. 9 illustrates another pedestal-type support 140 for the air circulation device 12 such as that illustrated in FIGS. 1–3 in which the spherical housing 14 is supported from a generally cup shaped support member 142 mounted on the upper end of a tubular standard 144.

FIG. 10 illustrates the structure of the cup shaped member 142 which is partially spherical in configuration and provided with a concave upper surface 146 which conforms with and engages the bottom surface of the housing 14. The tubular standard 144 includes the electric conducter 46 which extends down through the center thereof and through an opening in a plate 148 adjacent the upper end of the stand with a strain relief 150 being incorporated into the electrical conducter 46. The tubular standard 144 is supported by a circular base plate 152 and the tubular standard 144 may be telescopically adjusted to a desired elevation. FIG. 11 is a pedestal support 154 having a telescopic standard 156 selectively locked by a cam lock 158 or other suitable lock. The standard 156 tapers outwardly and merges with the lower portion of a spherical housing 14'. FIG. 12 illustrates the use of three supporting legs 158 to support the spherical housing 14''. Many different designs may be provided using the basic structural features of the housings and blower.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An air circulation device comprising a hollow housing, an air blower mounted in said housing and including an impeller and an impeller casing having an air inlet and outlet, said hollow housing including an air inlet and air outlet with the air outlet from the casing being connected to the air outlet in the housing for discharging pressurized air from the housing, the inlet for the hollow housing being spaced from the casing to enable inlet air to completely enclose the blower for entry into the air inlet of the impeller casing and means adjustably supporting said hollow housing, said hollow housing including a curved external surface with the air inlet being defined by a slot extending around a substantial portion of the curved surface of the housing, said air inlet for the housing being formed by a downwardly opening arcuate slot along a portion of the hollow housing opposite the air outlet, said hollow housing being substantially spherical in configuration, said supporting means for the housing including an annular member engaging and supporting the lower surface portion of the hollow housing and enabling the hollow housing to be pivoted about a vertical axis and a horizontal axis to direct the air outlet in a desired direction.

2. The structure as defined in claim 1 wherein said annular member is in the form of a generally cylindrical ring having a diameter less than the diameter of the spherical housing and a pair of diametrically opposed supporting members connected to opposite sides of the ring and terminating in substantially flat lower ends for engaging a supporting surface.

3. The structure as defined in claim 2 wherein the portion of the hollow housing above the air outlet and air inlet includes an insert capable of transmitting light, and an illumination means interiorly of the housing to provide a light at the upper end portion of the housing.

4. The structure as defined in claim 3 wherein said air inlet is formed by an upper portion of the housing projecting laterally beyond a lower portion in spaced relation thereto to form an arcuate inlet, filter means in the air inlet for filtering air entering the interior of the housing.

5. The structure as defined in claim 4 wherein said blower casing outlet is spaced from the housing outlet with a peripheral transition member being connected to the casing outlet and interior of the housing peripherally of the air outlet in sealed relation thereto for discharge of pressurized air from the air outlet in the housing.

6. An air circulation device comprising a hollow housing, an air blower mounted in said housing and including an impeller and an impeller casing having an air inlet and outlet, said hollow housing including an air inlet and air outlet with the air outlet from the casing being connected to the air outlet in the housing for discharging pressurized air from the housing, the inlet for the hollow housing being spaced from the casing to enable inlet air to completely enclose the blower for entry into the air inlet of the impeller casing and means adjustably supporting said hollow housing, said hollow housing including a curved external surface with the air inlet being defined by a slot extending around a substantial portion of the curved surface of the housing, said air inlet for the housing being formed by a downwardly opening arcuate slot along a portion of the hollow housing opposite the air outlet, said housing being substantially egg shaped with the major axis thereof extending vertically, said supporting means for the housing including a supporting base having a concave top wall supportingly engaging the bottom curved end surface of the housing, means connecting the lower end of the housing to the base to enable pivotal movement about a transverse axis and pivotal movement about a vertical axis for varying the orientation of the air outlet in the housing.

7. The structure as defined in claim 6 wherein said air outlet in the housing is defined by a plurality of generally parallel slots extending arcuately and horizontally around a substantial portion of the periphery of the housing adjacent the vertical central portion thereof, said air blower casing outlet being connected to the air outlet in the housing by a transition member connected sealingly and peripherally to the air outlet for the casing and the interior of the housing peripherally of the air outlet for the housing.

8. The structure as defined in claim 7 wherein said air inlet for the housing is provided by a projecting portion of the housing being spaced from a lower interior portion of the housing to form an arcuate intake slot facing downwardly toward the supporting base, filter means in the air inlet slot for filtering air entering the housing.

9. The structure as defined in claim 8 wherein the upper end portion of the housing includes a portion capable of transmitting light, an illumination means positioned interiorly of the upper end portion of the housing to form a light.

10. An air circulation device comprising a hollow housing, an air blower mounted in said housing and including an impeller and an impeller casing having an air inlet and outlet, said hollow housing including an air inlet and air outlet with the air outlet from the casing being connected to the air outlet in the housing for discharging pressurized air from the housing, the inlet for the hollow housing being spaced from the casing to enable inlet air to completely enclose the blower for entry into the air inlet of the impeller casing and means adjustably supporting said hollow housing, said hollow housing including a curved external surface with the air inlet being defined by a slot extending around a substantial portion of the curved surface of the housing, said air inlet for the housing being formed by a downwardly opening arcuate slot along a portion of the hollow housing opposite the air outlet, said supporting means for the housing including a pedestal-type support engaging a bottom curved surface of the housing to enable the housing to be adjusted about a vertical and transverse axis to orient the housing and the air outlet to a desired position.

* * * * *